US007565908B2

(12) United States Patent
Liu

(10) Patent No.: US 7,565,908 B2
(45) Date of Patent: Jul. 28, 2009

(54) APPARATUS WITH ELECTRIC HEATING UNIT FOR WATER-PIPE SMOKING

(76) Inventor: Chun-Liang Liu, No. 621, Tawan Road, Yungkang City, Tainan Hsien (TW)

( * ) Notice: Subject to any disclaimer, the term of this patent is extended or adjusted under 35 U.S.C. 154(b) by 835 days.

(21) Appl. No.: 11/248,318

(22) Filed: Oct. 13, 2005

(65) Prior Publication Data

US 2006/0086364 A1 Apr. 27, 2006

(30) Foreign Application Priority Data

Oct. 26, 2004 (TW) ..... 93217001 U

(51) Int. Cl.
*A24F 1/14* (2006.01)
*A24F 1/30* (2006.01)

(52) U.S. Cl. ..... 131/173; 131/194; 131/196; 131/271; D27/163; D27/165

(58) Field of Classification Search ..... None
See application file for complete search history.

(56) References Cited

U.S. PATENT DOCUMENTS 4,133,318 A * 1/1979 Gross et al. ..... 131/173

* cited by examiner

*Primary Examiner*—Philip C Tucker
*Assistant Examiner*—Phu H Nguyen
(74) *Attorney, Agent, or Firm*—Pearl Cohen Zedek Latzer, LLP

(57) ABSTRACT

In an apparatus for water-pipe smoking, a liquid container and a bowl unit are disposed in a hollow base. The liquid container includes a container body to be partially filled with a liquid body, a smoke guide duct having first and second duct portions that respectively extend out of and into the container body, and a smoke passage accessible via a radial access hole in the hollow base. The bowl unit is coupled to the first duct portion, holds combustible smoking material therein, and allows smoke that results from combustion of the smoking material in the bowl unit to flow into the smoke guide duct. An electric heating unit is mounted to a top cover that covers a top side of the hollow base, and is operable so as to generate heat for causing the smoking material in the bowl unit to combust.

10 Claims, 9 Drawing Sheets

APPARATUS WITH ELECTRIC HEATING UNIT FOR WATER-PIPE SMOKING

CROSS-REFERENCE TO RELATED APPLICATION

This application claims priority from Taiwanese application no. 093217001, filed on Oct. 26, 2004.

BACKGROUND OF THE INVENTION

1. Field of the Invention

The invention relates to an apparatus for water-pipe smoking, more particularly to an apparatus with an electric heating unit for water-pipe smoking.

2. Description of the Related Art

Referring to FIG. 1, a conventional water-pipe 1 is shown to comprise an upright pipe body 11, a smoke guide duct 12 extended into the pipe body 11, a bowl body 13 mounted on top of the pipe body 11, a cover plate 14 disposed in the bowl body 13, and a mouthpiece unit 15 coupled to the pipe body 11. The pipe body 11 has a lower portion formed with a reservoir 111 to be partially filled with a liquid body (such as water). The pipe body 11 further has a spout 112 in fluid communication with the reservoir 111 above the liquid body. The smoke guide duct 12 has a lower end that extends into the liquid body in the reservoir 111, and an upper end that extends into a smoke passageway 131 of the bowl body 13. The cover plate 14 spans the smoke passageway 131, and prevents combustible smoking material in the bowl body 13 from falling into the smoke passageway 131.

In use, the combustible smoking material is placed in the bowl body 13 on top of the cover plate 14, and is subsequently covered with a tin foil 16. Burning charcoal 17 is then placed on top of the tin foil 16 for causing the smoking material to combust. Smoke that results from combustion of the smoking material flows through the smoke guide duct 12 into the liquid body in the reservoir 111. The liquid body can filter out ash and other impurities in the smoke. The filtered smoke subsequently bubbles through the liquid body, and can be inhaled by the smoker through the mouthpiece unit 15.

In the aforesaid conventional water-pipe 1, the charcoal 17 is in a burning state when placed in the bowl body 13. Therefore, as the temperature of the charcoal 17 drops over time, the flavor of the smoke being inhaled by the smoker deteriorates (i.e., the flavor becomes weaker and less concentrated), which necessitates more charcoal 17 to be placed in the bowl body 13. In addition, the burning charcoal 17 must be removed before more smoking material can be added into the bowl body 13. These result in inconvenience and safety issues when the conventional water-pipe 1 is in use.

SUMMARY OF THE INVENTION

Therefore, the object of the present invention is to provide an apparatus for water-pipe smoking that can overcome the aforesaid drawbacks associated with the prior art.

According to the present invention, an apparatus for water-pipe smoking includes a hollow base, a top cover, a liquid container, a bowl unit, and an electric heating unit.

The hollow base has a top side, and includes a surrounding wall that confines an accommodation space and that is formed with a radial access hole in spatial communication with the accommodation space.

The top cover is used to cover the top side of the hollow base.

The liquid container is disposed in the accommodation space, and includes a container body, a smoke guide duct, and a smoke passage. The container body confines a container chamber that has a lower chamber part adapted to be filled with a liquid body, and an upper chamber part above the lower chamber part. The smoke guide duct has a first duct portion extending out of the container chamber, and a second duct portion extending into the lower chamber part of the container chamber. The smoke passage is in fluid communication with the upper chamber part of the container chamber, and is accessible via the access hole in the hollow base.

The bowl unit is disposed in the accommodation space, is coupled to the first duct portion of the smoke guide duct, is adapted for holding combustible smoking material therein, and allows smoke that results from combustion of the smoking material in the bowl unit to flow into the smoke guide duct.

The electric heating unit is mounted to the top cover, is disposed close to the bowl unit when the top cover covers the top side of the hollow base, and is operable so as to generate heat for causing the smoking material in the bowl unit to combust.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
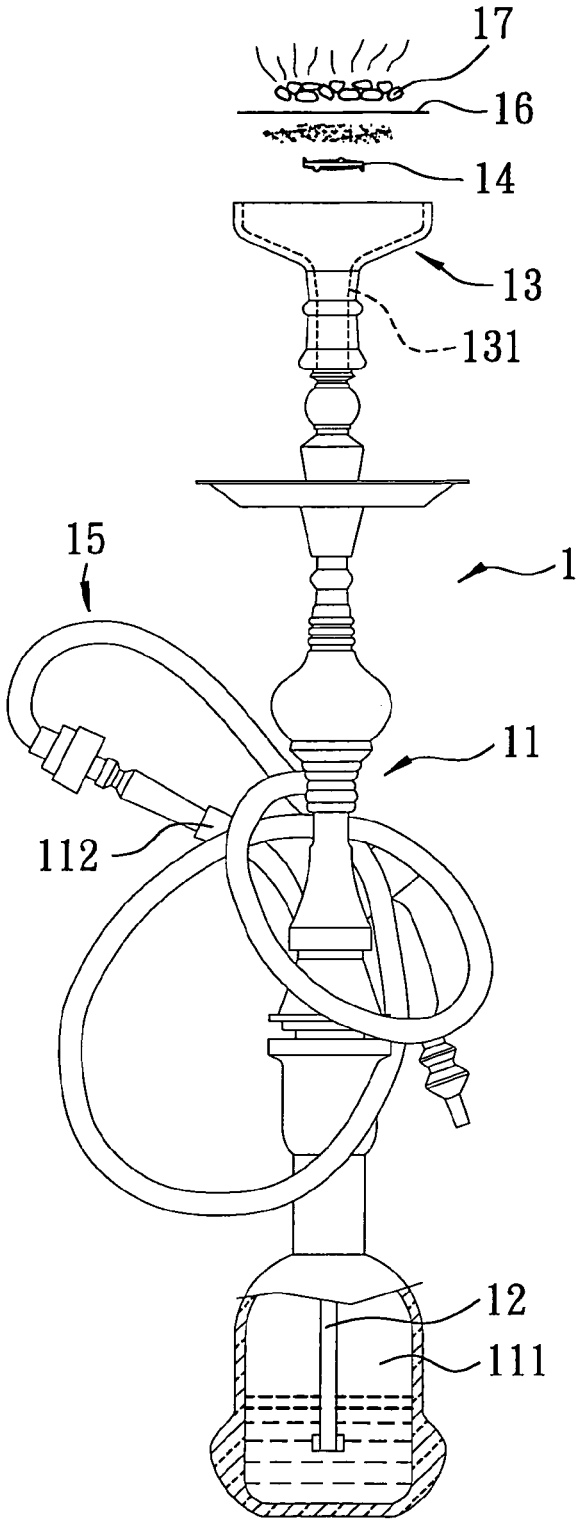
FIG. 1 PRIOR ART
FIG. 1 is a schematic partly sectional view of a conventional water-pipe.
Figure 2:
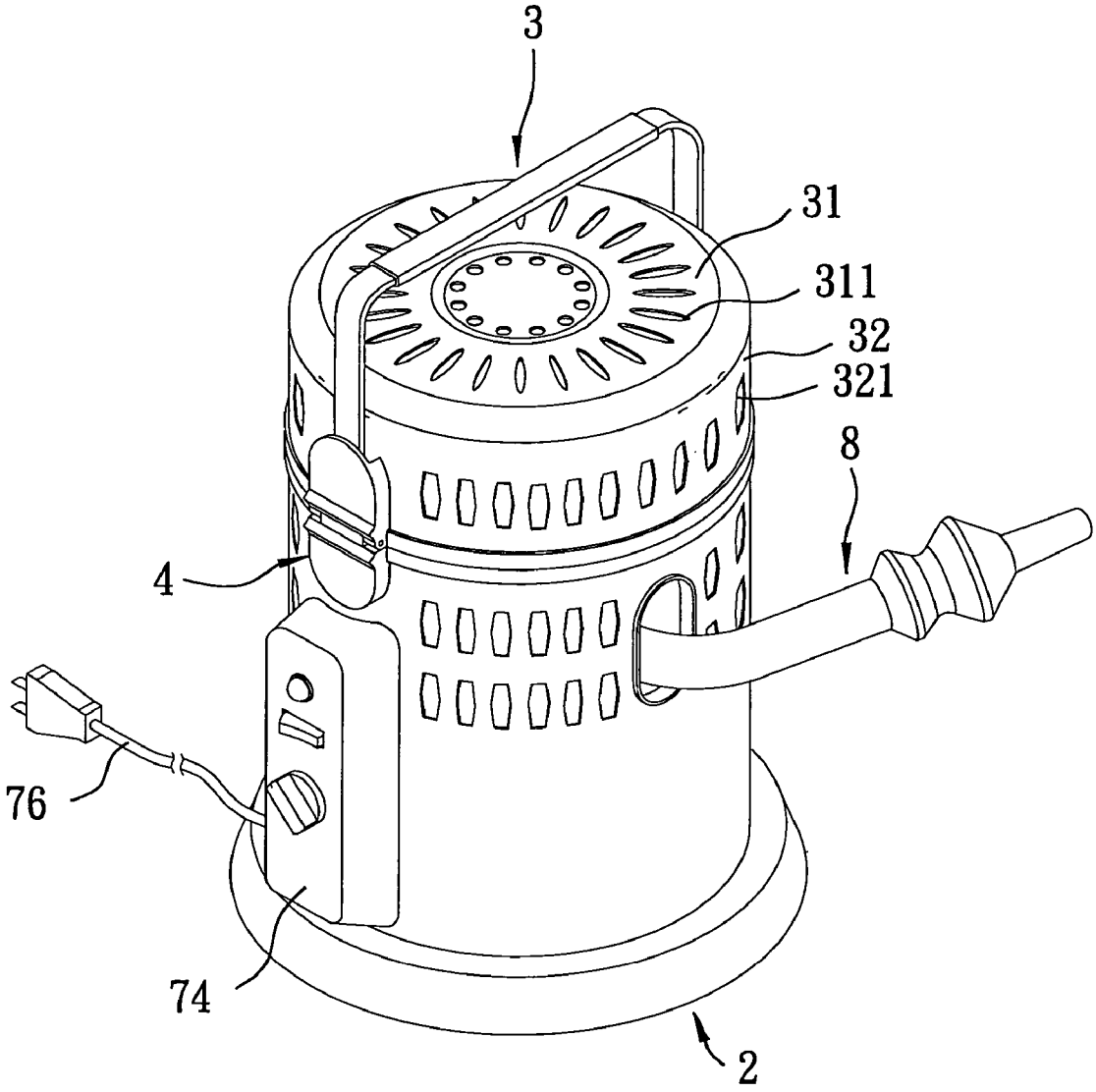
FIG. 2 is a perspective view of the first preferred embodiment of an apparatus for water-pipe smoking according to the present invention.
Figure 3:
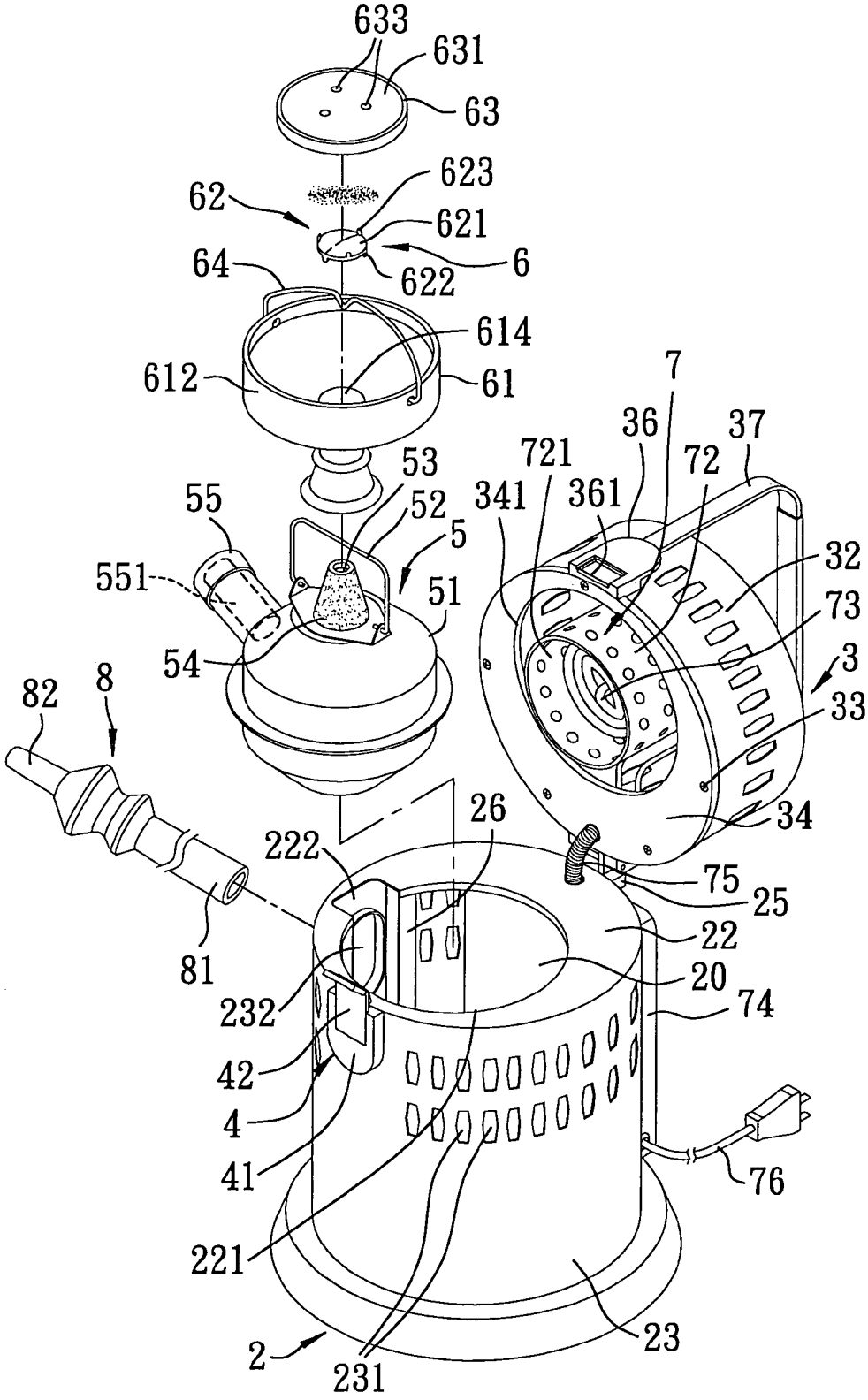
FIG. 3 is an exploded perspective view of the first preferred embodiment.
Figure 4:
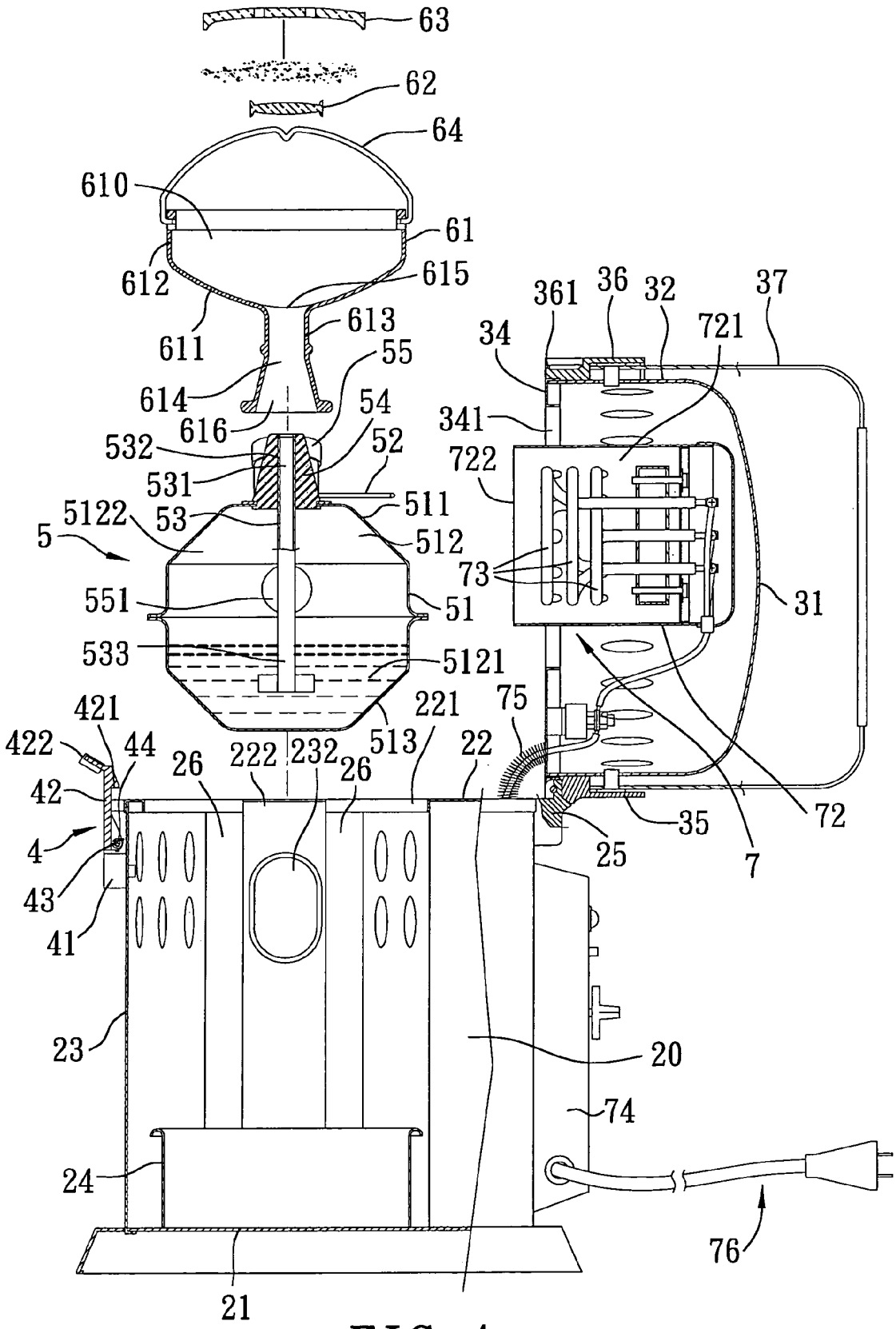
FIGS. 4 and 5 are exploded schematic partly sectional views of the first preferred embodiment.
Figure 5:
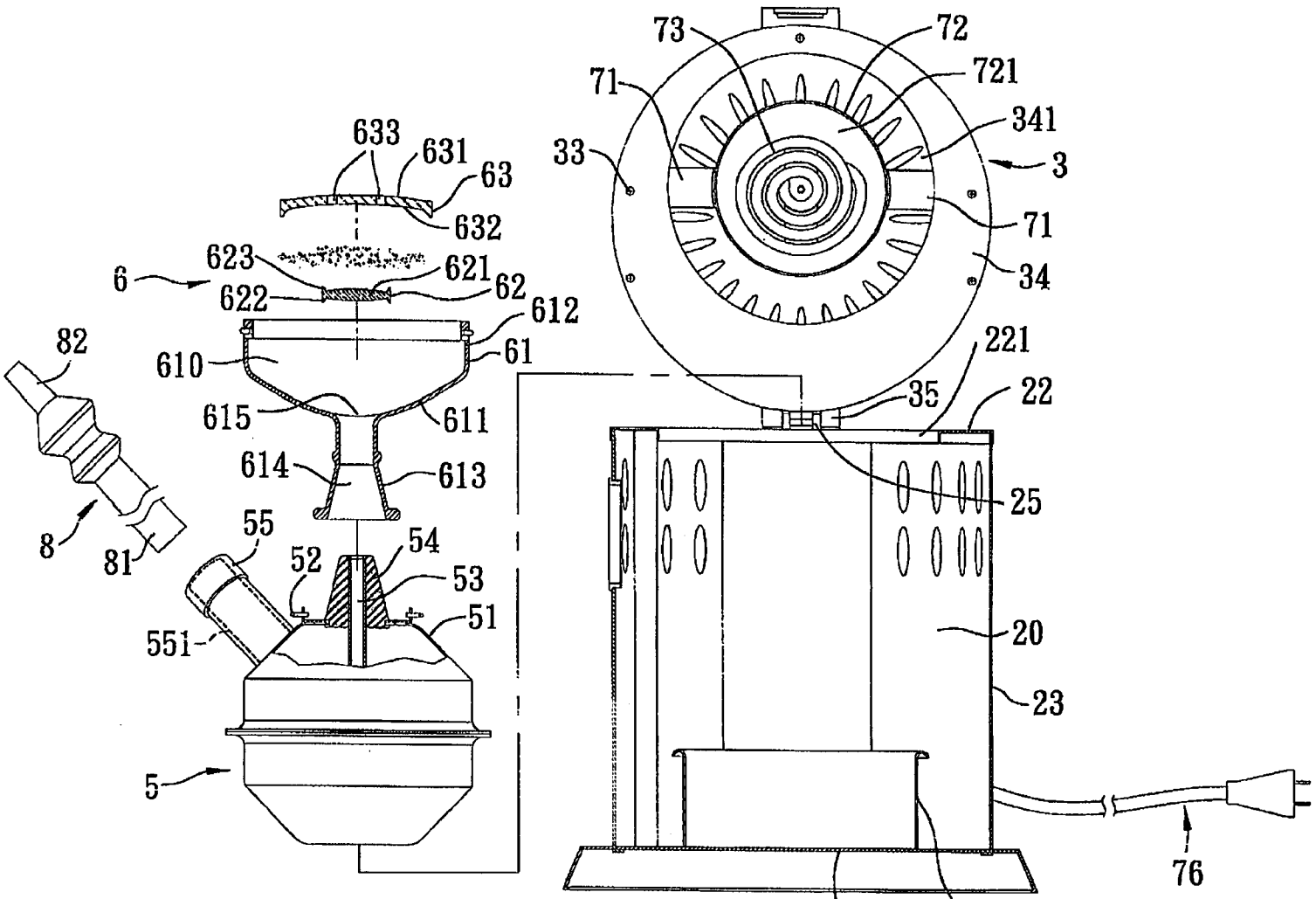
Figure 6:
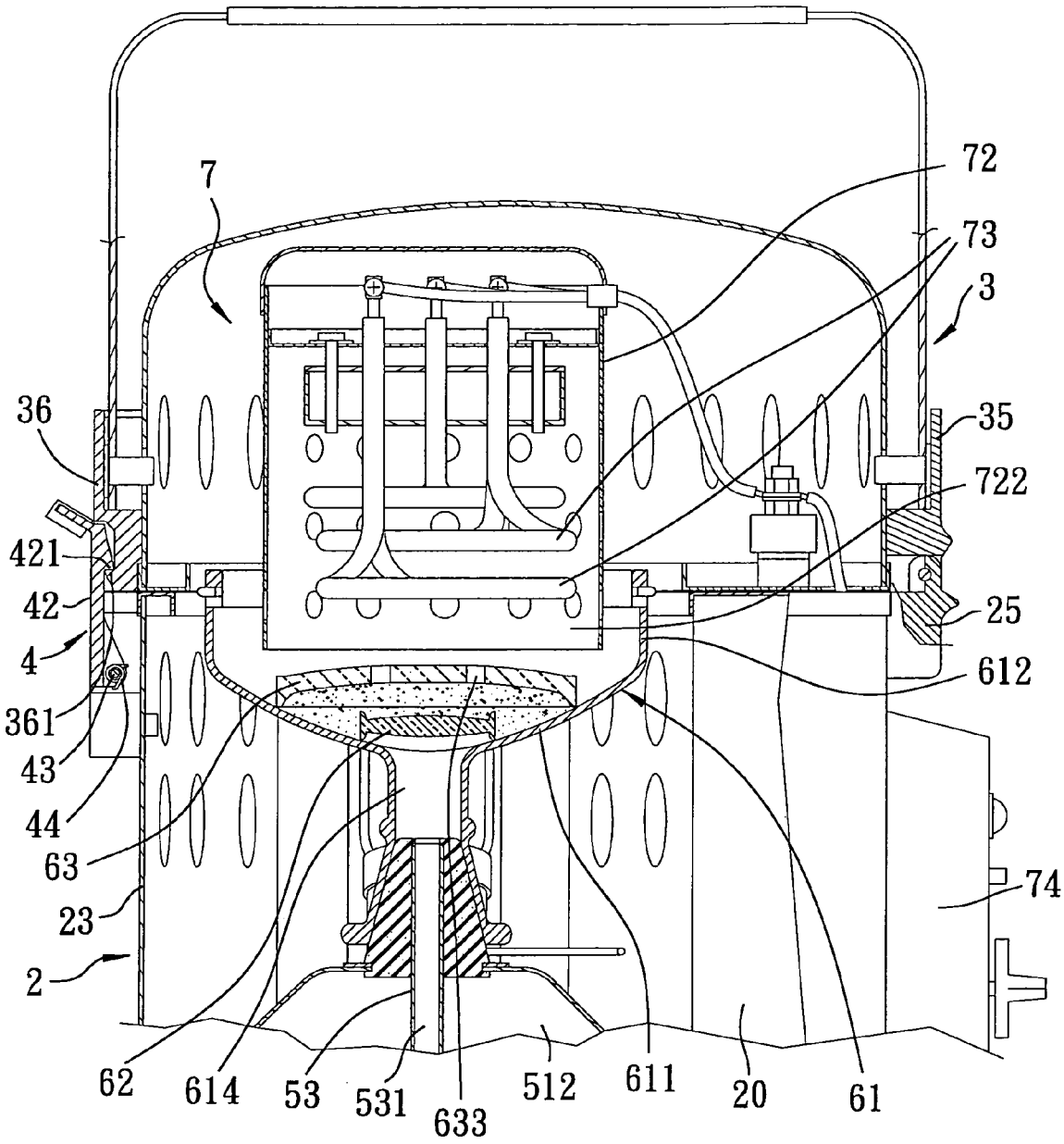
FIG. 6 is a fragmentary schematic sectional view of the first preferred embodiment.
Figure 7:
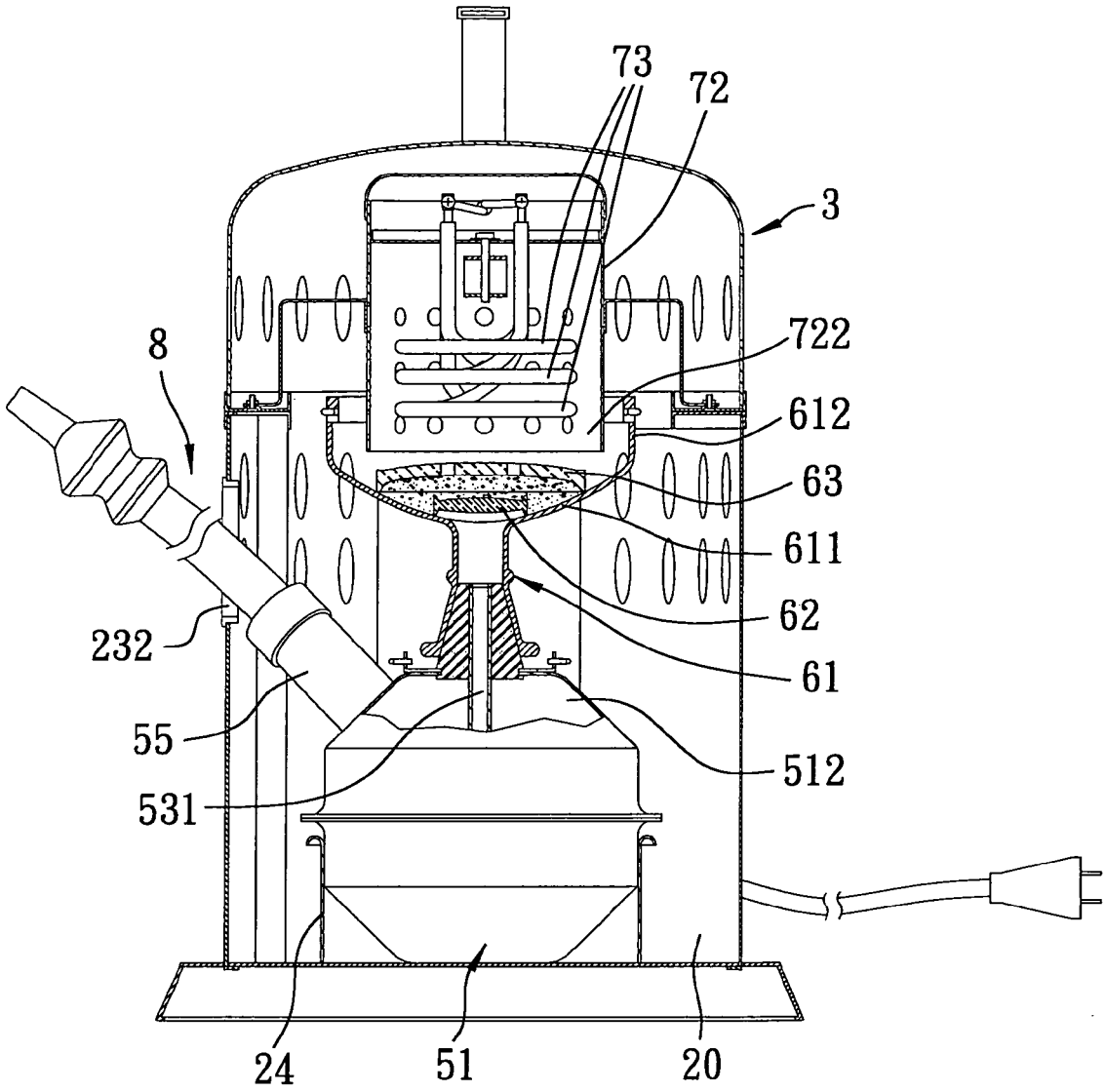
FIG. 7 is an assembled schematic sectional view of the first preferred embodiment.

Before the present invention is described in greater detail with reference to the accompanying preferred embodiments, it should be noted herein that like elements are denoted by the same reference numerals throughout the disclosure.

Referring to FIGS. 2 to 7, the first preferred embodiment of an apparatus for water-pipe smoking according to the present invention is shown to include a hollow base 2, a top cover 3, a spring-loaded latch unit 4, a liquid container 5, a bowl unit 6, an electric heating unit 7, and a mouthpiece unit 8.

The hollow base 2 includes a surrounding wall 23 that confines an accommodation space 20 and that is formed with a radial access hole 232 in spatial communication with the accommodation space 20, a bottom wall 21 connected to the surrounding wall 23 for closing a bottom side of the hollow base 2, a top wall 22 connected to the surrounding wall 23 at a top side of the hollow base 2 and formed with an access opening 221 for access into the accommodation space 20, and a container frame 24 extending from the bottom wall 21 into the accommodation space 20 for holding the liquid container 5. The surrounding wall 23 is formed with perforations 231, and is provided with a cover mounting part 25 on a top edge thereof. The access opening 221 is vertically aligned with the container frame 24, and has a periphery formed with a notch 222 that is vertically aligned with the access hole 232. The hollow base 2 is formed with a pair of positioning posts 26 disposed respectively at opposite lateral sides of the access hole 232.

The top cover 3 is connected pivotally to the hollow base 2 at the cover mounting part 25 on the surrounding wall 23 of the hollow base 2, and is operable so as to cover and uncover the access opening 221 in the top wall 22 of the hollow base 2. The top cover 3 includes a top wall 31 formed with a plurality of vent holes 311, an enclosing wall 32 extending downwardly from an outer edge of the top wall 31 and formed with a plurality of vent holes 321, a mounting wall 34 connected to a bottom edge of the enclosing wall 32 via a set of fasteners 33 and spaced apart from the top wall 31, first and second handle connecting parts 35, 36 provided on diametrically opposite positions of the enclosing wall 32, and an inverted U-shaped handle 37 having opposite ends connected pivotally and respectively to the handle connecting parts 35, 36. The mounting wall 34 is formed with a through hole 341 registered with the access opening 221 in the top wall 22 of the hollow base 2 when the top cover 3 covers the top side of the hollow base 2. The second handle connecting part 36 is configured with a lower engaging edge 361.

The latch unit 4 serves to retain releasably the top cover 3 at a covering position on the hollow base 2, and includes a latch mounting part 41 provided on the surrounding wall 23 of the hollow base 2, a latching plate 42, a pivot pin 43 for mounting pivotally a lower edge of the latching plate 42 on the latch mounting part 41, and a torsion spring 44 for biasing the latching plate 42 to a latching position. The latching plate 42 has a distal operating portion 422 and a latching edge 421 below the operating portion 422. When the top cover 3 is pivoted to the covering position, the engaging edge 361 of the second handle connecting part 36 on the top cover 3 initially pushes the latching plate 42 to pivot away from the latching position. When the engaging edge 361 eventually moves under the latching edge 421 of the latching plate 42, the latching plate 42 moves to the latching position to result in engagement between the engaging and latching edges 361, 421 by virtue of the restoring force of the torsion spring 44. Thereafter, when it is desired to uncover the access opening 221 in the top wall 22 of the hollow base 2, the operating portion 422 of the latching plate 42 is operated to move the latching plate 42 away from the latching position, thereby permitting pivoting movement of the top cover 3 away from the top wall 22 of the hollow base 2.

The liquid container 5 is disposed removably in the accommodation space 20 of the hollow base 2, and includes a container body 51, a handle 52 connected pivotally to the container body 51, and a smoke guide duct 53.

The container body 51 includes a kettle wall 511 and a spout 55 that extends upwardly from the kettle wall 511 and that is formed with a smoke passage 551. The kettle wall 511 defines a container chamber 512, and has a tapering bottom section 513 to be extended into the container frame 24. The container chamber 512 has a lower chamber part 5121 adapted to be filled with a liquid body (such as water), and an upper chamber part 5122 above the lower chamber part 5121. The notch 222 in the top wall 22 and the positioning posts 26 of the hollow base 2 serve to orient the spout 55 relative to the access hole 232 such that the smoke passage 551 is accessible via the access hole 232. The smoke passage 551 is in fluid communication with the upper chamber part 5122 of the container chamber 512.

The smoke guide duct 53 defines a duct channel 531, and has a first duct portion 532 extending out of the container chamber 512, and a second duct portion 533 extending into the lower chamber part 5121 of the container chamber 512.

The bowl unit 6 is disposed in the accommodation space 20 of the hollow base 2, is coupled to the first duct portion 532 of the smoke guide duct 53, is adapted for holding combustible smoking material (such as tobacco) therein, and allows smoke that results from combustion of the smoking material in the bowl unit 6 to flow into the smoke guide duct 53. The bowl unit 6 includes a bowl body 61, a cover plate 62, a partition plate 63, and a handle 64.

The bowl body 61 has a base wall 611 with an outer peripheral edge, a peripheral wall 612 extending upwardly from the outer peripheral edge of the base wall 611 and cooperating with the base wall 611 to confine a holding space 610 for the smoking material, a coupling part 613 extending downwardly from the base wall 611 and coupled to the first duct portion 532 of the smoke guide duct 53, and a smoke passageway 614 formed through the coupling part 613 and the base wall 611 to communicate fluidly the holding space 610 and the smoke guide duct 53. In this embodiment, the smoke passageway 614 has an inlet part 615 formed in the base wall 611, and an outlet part 616 that gradually diverges in a direction away from the inlet part 615. Preferably, the first duct portion 532 of the smoke guide duct 53 extends into the outlet part 616 of the smoke passageway 614, and the liquid container 5 further includes a leak-proof sleeve 54 provided on the first duct portion 532 for establishing a leak-proof seal among the container body 51, the smoke guide duct 53, and the coupling part 613 of the bowl body 61.

The cover plate 62 has a cover body 621 disposed in the holding space 610 of the bowl body 61 above the coupling part 613 so as to span the inlet part 615 of the smoke passageway 614, a plurality of first spacer protrusions 622 that project downwardly from the cover body 621 and that abut against the base wall 611 of the bowl body 61, and a plurality of second spacer protrusions 623 that project upwardly from the cover body 621. The spacer protrusions 622 serve to maintain a clearance between the cover body 621 and the base wall 611 to enable smoke resulting from combustion of the smoking material to flow into the smoke passageway 614.

The partition plate 63 is a convex plate having a top side 631, a bottom side 632, and a plurality of holes 633 extending through the top and bottom sides 631, 632.

The handle 64 is connected pivotally to the peripheral wall 612 of the bowl body 61.

The electric heating unit 7 is mounted to the top cover 3, is disposed close to the bowl unit 6 when the top cover 3 covers the top side of the hollow base 2, and is operable so as to generate heat for causing the smoking material in the bowl unit 6 to combust. The electric heating unit 7 includes a set of electric heating elements 73 in the form of coils, and a shroud 72 confining a heating space 721 and having the electric heating elements 73 mounted therein. The electric heating unit 7 further includes a pair of positioning plates 71 that interconnect the shroud 72 and the mounting wall 34. The shroud 72 extends through the through hole 341 in the mounting wall 34, and has an open end part 722 that extends into the bowl body 61 of the bowl unit 6 when the top cover 3 covers the top side of the hollow base 2. In this embodiment, a controller 74 is mounted fixedly on the surrounding wall 23 of the hollow base 2, and a cable 75 interconnects electrically the heating elements 73 and the controller 74. A power cord 76 extends from the controller 74 and is adapted for connecting electrically to an AC power outlet (not shown). The controller 74 serves to control activated and deactivated states of the heating elements 73, as well as the heating time and/or temperature of the heating elements 73 in accordance with the smoker's needs.

The mouthpiece unit 8 includes an inhaling segment 82 and a coupling segment 81 opposite to the inhaling segment 82. The coupling segment 81 is extended into the hollow base 2 via the access hole 232 so as to couple removably with the spout 55 of the container body 51.

Before the apparatus of this invention is put to use, the container body 51 of the liquid container 5 is removed from the accommodation space 20 of the hollow base 2. The lower chamber part 5121 of the container chamber 512 is then filled with the liquid body via the smoke passage 551 in the spout 55 such that the second duct portion 533 of the smoke guide duct 53 extends into the liquid body. The upper chamber part 5122 of the container chamber 512 is filled with air at this time. Thereafter, the liquid container 5 is put back into the accommodation space 20 such that the tapering bottom section 513 of the kettle wall 511 extends into the container frame 24. The notch 222 in the top wall 22 and the positioning posts 26 of the hollow base 2 ensure proper orientation of the spout 55 relative to the access hole 232. Next, the bowl body 61 of the bowl unit 6 is coupled to the first duct portion 532 of the smoke guide duct 53 by extending the first duct portion 532 together with the leak-proof sleeve 54 into the outlet part 616 of the smoke passageway 614 that is formed through the coupling part 613 of the bowl body 61. The cover plate 62 is then disposed in the holding space 610 of the bowl body 61 so as to span the inlet part 615 of the smoke passageway 614. At this time, due to the presence of the spacer protrusions 622, a clearance is maintained between the cover body 621 and the base wall 611 of the bowl body 61. After placing the combustible smoking material in the holding space 610 above the cover plate 62, the smoking material is covered with the partition plate 63. The coupling segment 81 of the mouthpiece unit 8 is then extended into the hollow base 2 via the access hole 232 so as to couple with the spout 55 of the container body 51. Upon moving the top cover 3 to the covering position on the hollow base 2 in the manner described hereinabove, the open end part 722 of the shroud 72 of the electric heating unit 7 extends into the bowl body 61, and is disposed immediately above the partition plate 63. Subsequently, when the heating elements 73 are activated through the controller 74, heat generated by the heating elements 73 passes through the holes 633 in the partition plate 63 to result in combustion of the smoking material in the bowl body 61. The smoke that results from combustion of the smoking material flows through the clearance between the cover plate 62 and the base wall 611 of the bowl body 61, into the smoke passageway 614, through the duct channel 531 of the smoke guide duct 53, and into the liquid body in the lower chamber part 5121 of the container chamber 512 of the container body 51 of the liquid container 5. The liquid body can filter out ash and other impurities in the smoke. The filtered smoke bubbles through the liquid body to reach the upper chamber part 5122 of the container chamber 512, and exits the container chamber 512 via the smoke passage 551 in the spout 55 of the container body 51 so as to be inhaled by the smoker through the mouthpiece unit 8.

When it is desired to add more smoking material or remove components of the apparatus from the accommodation space 20, the latch unit 4 is operated to permit movement of the top cover 3 away from the top wall 22 of the hollow base 2. Therefore, this invention not only facilitates temperature control for smoking material, but is also more convenient and safer to use when compared to conventional water-pipes that use charcoal.

Figure 8:
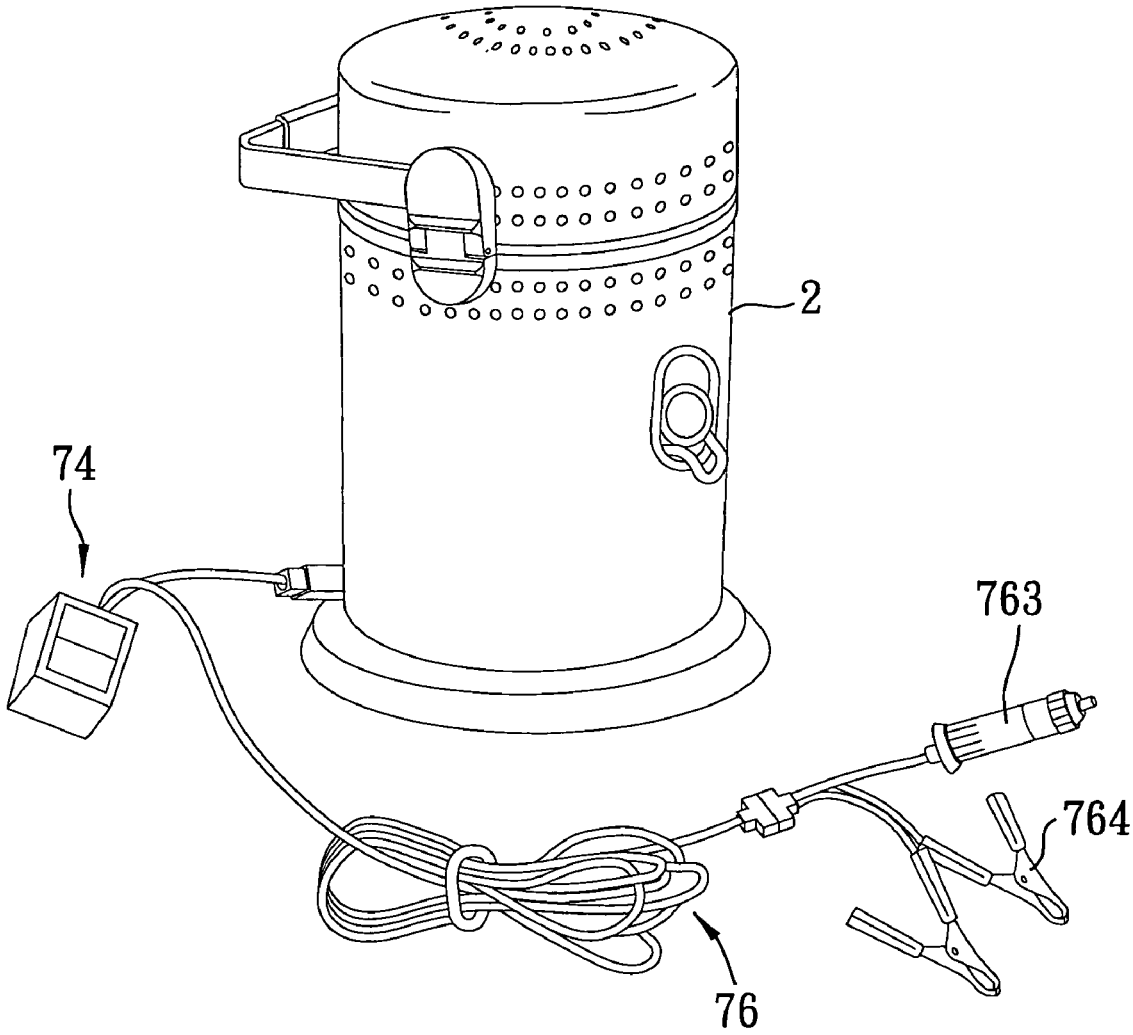
FIG. 8 is a perspective view of the second preferred embodiment of an apparatus for water-pipe smoking according to the present invention.
Figure 9:
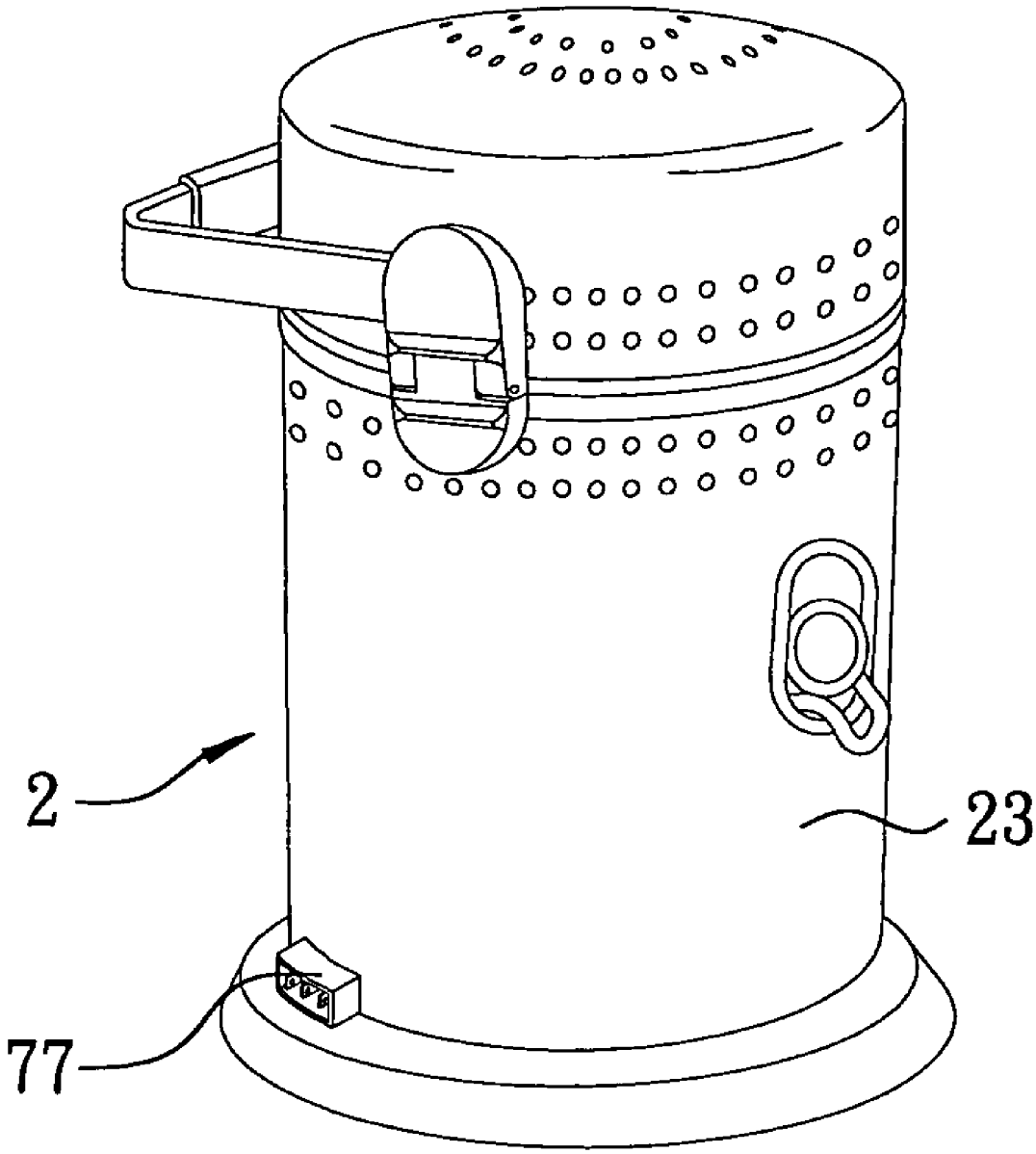
FIG. 9 is a perspective view of the third preferred embodiment of an apparatus for water-pipe smoking according to the present invention.

Referring to FIG. 8, in the second preferred embodiment of the apparatus according to this invention, the controller 74 is separate from the hollow base 2, and the power cord 76 is terminated by a plug 763 adapted for connection to an automobile lighter socket (not shown), and a pair of clamps 764 adapted for connection to a car battery (not shown). The configuration as such permits use of the apparatus outdoors. Referring to FIG. 9, in the third preferred embodiment of the apparatus according to this invention, the surrounding wall 23 of the hollow base 2 is provided with a power socket 77 for connection to a power cord (not shown).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An apparatus for water-pipe smoking, comprising:

a hollow base having a top side and including a surrounding wall that confines an accommodation space and that is formed with a radial access hole in spatial communication with said accommodation space;

a top cover for covering said top side of said hollow base;

a liquid container disposed in said accommodation space and including a container body confining a container chamber that has a lower chamber part adapted to be filled with a liquid body, and an upper chamber part above said lower chamber part, a smoke guide duct having a first duct portion extending out of said container chamber and a second duct portion extending into said lower chamber part of said container chamber, and a smoke passage in fluid communication with said upper chamber part of said container chamber and accessible via said access hole in said hollow base;

a bowl unit disposed in said accommodation space, coupled to said first duct portion of said smoke guide duct, adapted for holding combustible smoking material therein, and allowing smoke that results from combustion of the smoking material in said bowl unit to flow into said smoke guide duct; and an electric heating unit mounted to said top cover, disposed close to said bowl unit when said top cover covers said top side of said hollow base, and operable so as to generate heat for causing the smoking material in said bowl unit to combust said top cover includes a top wall having an outer edge, an enclosing wall extending downwardly from said outer edge of said top wall, and a mounting wall connected to said enclosing wall and spaced apart from said top wall, said mounting wall being formed with a through hole to be aligned with said bowl unit;

said electric heating unit including an electric heating element and a shroud for mounting said electric heating element therein, said shroud being mounted in said top cover and extending through said through hole in said mounting wall, said shroud extending into said bowl unit when said top cover covers said top side of said hollow base.

2. The apparatus as claimed in claim 1, wherein said hollow base has a bottom side opposite to said top side and further includes:

a bottom wall connected to said surrounding wall for closing said bottom side of said hollow base;

a top wall connected to said surrounding wall at said top side of said hollow base and formed with an access opening for access into said accommodation space; and a container frame extending from said bottom wall into said accommodation space for holding said liquid container.

3. The apparatus as claimed in claim 2, wherein said container body of said liquid container includes a kettle wall that defines said container chamber and that has a tapering bottom section extending into said container frame.

4. The apparatus as claimed in claim 1, wherein said container body of said liquid container includes a spout that is formed with said smoke passage.

5. The apparatus as claimed in claim 4, wherein said hollow base is formed with a pair of positioning posts disposed respectively at opposite lateral sides of said access hole for orienting said spout relative to said access hole.

6. The apparatus as claimed in claim 4, further comprising a mouthpiece unit including an inhaling segment and a coupling segment opposite to said inhaling segment and coupled to said spout of said container body.

7. The apparatus as claimed in claim 1, wherein said bowl unit includes:

a bowl body having a base wall with an outer peripheral edge, a peripheral wall extending upwardly from said outer peripheral edge of said base wall and cooperating with said base wall to confine a holding space for the smoking material, a coupling part extending downwardly from said base wall and coupled to said first duct portion of said smoke guide duct of said liquid container, and a smoke passageway formed through said coupling part and said base wall to communicate fluidly said holding space and said smoke guide duct; and a cover plate having a cover body disposed in said holding space above said coupling part, and a plurality of spacer protrusions that project downwardly from said cover body and that abut against said base wall of said bowl body.

8. The apparatus as claimed in claim 7, wherein said first duct portion of said smoke guide duct extends into said smoke passageway, and said liquid container further includes a leak-proof sleeve provided on said first duct portion for establishing a leak-proof seal among said container body, said smoke guide duct, and said coupling part of said bowl body.

9. The apparatus as claimed in claim 1, wherein said top cover is connected pivotally to said hollow base.

10. The apparatus as claimed in claim 9, further comprising a spring-loaded latch unit for retaining releasably said top cover at a covering position on said hollow base.

* * * * *